US008627585B2

(12) United States Patent
Herman Baran et al.

(10) Patent No.: US 8,627,585 B2
(45) Date of Patent: Jan. 14, 2014

(54) COVER FOR DISPLAY STRUCTURES

(75) Inventors: Bernardo Herman Baran, Estado de Mexico (MX); Mauricio Herman Dantus, Estado de Mexico (MX); Roman de Jesus Chavez Herrera, Estado de Mexico (MX); Mauricio Ricardo Benito Alvarez Cedeño, Estado de Mexico (MX)

(73) Assignee: POP Ontime Supply Services, S.A. DE C.V. (MX)

( * ) Notice: Subject to any disclaimer, the term of this patent is extended or adjusted under 35 U.S.C. 154(b) by 407 days.

(21) Appl. No.: 13/075,894

(22) Filed: Mar. 30, 2011

(65) Prior Publication Data

US 2011/0259904 A1 Oct. 27, 2011

Related U.S. Application Data

(60) Provisional application No. 61/318,976, filed on Mar. 30, 2010.

(51) Int. Cl.
*G09F 1/08* (2006.01)

(52) U.S. Cl.
USPC ..... 40/538; 40/312; 211/183; 53/174; 108/162; 108/165

(58) Field of Classification Search
USPC ..... 40/538, 312, 606.03, 606.05, 606.08; 211/186; 53/173, 174; 108/162, 165
See application file for complete search history.

(56) References Cited

U.S. PATENT DOCUMENTS

| | | | | | |
|---|---|---|---|---|---|
| 2,150,743 | A * | 3/1939 | Mancuso | 211/135 |
| 3,372,813 | A * | 3/1968 | Ishida | 211/135 |
| 3,877,396 | A * | 4/1975 | Patterson | 108/183 |
| 4,102,276 | A * | 7/1978 | Roveroni | 108/156 |
| 4,351,246 | A * | 9/1982 | Hutchins, Jr. | 108/156 |
| 4,630,740 | A * | 12/1986 | Belokin, Jr. | 211/194 |
| 4,638,745 | A * | 1/1987 | Sheffer | 108/192 |
| 4,854,246 | A * | 8/1989 | Belokin et al. | 108/162 |
| 5,335,593 | A * | 8/1994 | Stoddard et al. | 100/165 |
| 2003/0159319 | A1 * | 8/2003 | Ransom et al. | 40/306 |
| 2005/0109723 | A1 | 5/2005 | Czerwinski | 211/183 |

FOREIGN PATENT DOCUMENTS

| | | |
|---|---|---|
| JP | 2000-184946 | 7/2000 |
| KR | 2003-0090228 | 11/2003 |

* cited by examiner

*Primary Examiner* — Gary Hoge
(74) *Attorney, Agent, or Firm* — Ostrolenk Faber LLP

(57) ABSTRACT

A jacket structure for mounting to a display structure, the jacket structure comprising one or more panels having an inner side and an outer side with regards to the display structure, one or more members corresponding to columns of the display structure, one or more elements corresponding to a tray base of the display structure, the elements corresponding to a tray base of the display structure intersecting with the members corresponding to columns of the display structure, the intersection of the members corresponding to the column of the display structure and the elements corresponding to the tray base of the display structure forming a window through which a consumer can reach out to grab the product within the display structure, a horizontal flap in an upper side of the element corresponding to a tray base and a horizontal flap in a lower side of the element corresponding to a tray base, wherein the flaps are configured to form a locked tab structure when the jacket structure is in a mounted position, and vertical flaps formed from the parts corresponding to the column of the display structure towards the window, wherein the vertical flaps are configured to form a locked tab structure when the jacket structure in a mounted position.

16 Claims, 13 Drawing Sheets

COVER FOR DISPLAY STRUCTURES

CROSS-REFERENCE TO RELATED APPLICATIONS

This application claims benefit of provisional application No. 61/318,976 filed on Mar. 30, 2010.

FIELD OF THE INVENTION

The present invention relates to covers or jackets for product display structures, specifically covers or jackets which can be easily placed or removed from the display structure, with the covers or jackets being decorative and protective of the display structure.

BACKGROUND OF THE INVENTION

Constant population growth requires a large volume of manufactured products to be purchased. At the points of sale, structures which make it possible to carry a large volume of products in reduced spaces become essential, without losing focus of the main objective which is product display. The distributors of consumable products have difficulties when setting up product displays quickly and completely in the least possible amount of time onto a display structure, while also ensuring that the display structure are sufficiently capable of supporting the consumable products to be displayed.

Manufacturers try to solve these problems by sending their products packaged in a structure which is capable of transporting and displaying the products. While this is useful for certain products, there are other products which have to be set up in situ due to the type of product or to the manufacturer's preference.

There are several prior publications of displays which are assembled in situ. One of the objectives when assembling displays in situ is that the displays be assembled easily and quickly. This is so that the user assembling the displays may mount his display stand as efficiently as possible, so as to let consumers view and/or purchase the displayed product as soon as possible.

Preferably the display structure is covered by an advertising jacket or cover, which may also be used as protective layer for the display structure. However, setting up this advertising jacket can take time, which, as previously mentioned, is limited when setting up the display structure. Additionally, if the display structure is sent packaged with the advertising jacket, it is possible that given the rigidity of the display structure, the jacket could be scratched, bent or broken, in which case, the jacket layer would be either useless or would not attract consumer's attention. Therefore, what is needed is a covering layer which is easily mountable in situ over the display structure, as well as a covering layer which is easily un-mountable in situ.

Such covers are known in the art. Specifically, Japanese Patent Publication No. 2000184946 discloses a corner cover structure for an open display structure. The corner cover is placed at an angle at which a lower trim and a handrail provide support for the pieces which are hooked and a fixture for the part of the corner cover which is hooked. The cover is pulled downwardly and holes of the fixture are aligned with threaded holes of the cover. Screws are screwed then into the threaded holes. A lateral plate and a frontal plate are then securely fastened by the fixture. At this point, the corner cover is placed on the handrail. Additionally, the recessed part of the corner cover downwardly holds the lower mounting part of the lower trim side and the lower frontal end of a windshield is fixed unto the lower trim.

Additionally, Korean publication No. 20030090228 discloses an assembly structure of a cover for a display structure which comprises at least one fixed bracket formed at a first coupling surface, which is formed by bending a portion of the first cover of the display structure perpendicular to the remaining portion of the same, and an insertion groove of the bracket. After the fixed bracket is inserted into a second coupling surface, which is formed by twice bending the portion of a second case cover so as to be horizontally coupled to the first coupling surface, the bracket insertion grooves allow the second coupling surface to be inserted into the fixed bracket in a sliding manner, thereby becoming fastened to the first coupling surface.

Finally, US publication No. 2005/0109723 discloses a rack jacket comprising a support member portion for covering an external surface of at least one of a plurality of support members. The rack jacket also includes a cross brace portion, for covering an external surface of at least one cross brace set between at least two of the vertical support members. The rack jacket is sized and shaped to conform to an outer surface of the rack. This publication fails to show several features necessary for the proper covering of the display structure by the jacket. Specifically, the jacket in said publication fails to disclose panels for covering tray bases, and fails to disclose an appropriate manner of securing the jacket around the tray bases. Furthermore, the jacket in said publication fails to disclose a manner in which the jacket may be folded to occupy less space when stored or being transported. Since the prior art document shows a rigid display structure, specifically a material similar to wood and steel as seen in the figures, there is no need to re-enforce the display structure. However, the present invention allows re-enforcing the display structure with the flaps provided in the present application, hence providing a similar support than the prior art, with lighter materials.

Therefore, a protecting jacket for display structures is required, especially for foldable or semi-foldable display structures. The protecting jacket should have a hardness which is nonetheless high, and which is also easy to mount and un-mount. The materials for display structures are, for example, plastics such as polystyrenes, PVC, high density polyethylenes, polypropylenes, PET, etc., wood, metals which have a propensity to provide some flexibility, cardboard, corrugated cardboard, etc. On the other hand, the same characteristics are required for the layer or cover of the display structures, that is, flexibility or semi-flexibility, with a high degree of hardness, with the above-mentioned materials being preferred.

Additionally, a jacket or cover which covers all the outer parts of the display structure is required, so that the display structure is dressed. In this way, and that said dressing is able to attract consumer's attention, whether by means of advertising or with striking colors.

BRIEF DESCRIPTION OF THE INVENTION

The present invention refers to covers or jackets for display structures. The display structures are usually mounted in supermarkets or retail stores which have novelty products or products which attempt to capture the attention of consumers. So much so, that it is not unusual for supermarkets to set up these display structures with nearby fixed shelves, in a location where the consumer has no other option but to go around the display structure. In this way, the display structures attempt to attract the attention of the consumer. It is well known that the public's attention will be better captured through the use of different colors. On the other hand, should a same company want to advertise a product which must be associated with color X and subsequently a product which must be associated with color Y, it is most likely that the company would not be willing to go to the expense of two different display structures, especially because it is necessary to keep financial and ecological expenses at a minimum. Also the owner of the display structure may want to publicize two known different products in the same display structure, without necessarily producing new jackets; therefore combinable jackets are required.

Thus, the cover or jacket of the present invention is easily adaptable to a display structure with typical dimensions in the market. The cover or jacket is also able to be easily detached from the display structure, so that the display structure can be used for different products to be advertised. Furthermore, the jacket is easily adaptable to different shapes.

The jacket of the present invention mimics the outer part of the display structure. It is known in the art that display structures are usually in the shape of tetrahedrons, pentahedrons, hexahedrons, octahedrons, dodecahedrons, icosahedrons, icosidodecahedrons, rhombic triacontahedrons, elongated pentagonal cupolas, octagonal prisms, deltahedrons, stellated polyhedrons and zonohedrons among others, as well as in cylindrical forms. More frequently they are tetrahedrons and hexahedrons where the triangular prisms, cuboids and cubes are preferred. Usually, the panels of these display structures are incomplete or open, that is, the panels that are positioned on a vertical axis usually have windows, defined by columns and tray bases through which the consumer has access to the product being sold. The lower part of the panel may be a solid panel. On the upper part of the display structure, that is, on the upper panel in the horizontal axis, the panel can be solid or it may have a window through which the consumer has access to the upper tray in order to be able to grab the product of the uppermost part of the display structure. Thus, the cover or jacket which is proposed in the present invention mimics the display structure, that is, it can have any of the shapes mentioned above or it can cover at least part of the display structure.

Each part of the cover or jacket is composed of at least two main parts, where a first part covers or dresses the outer part of the display structure and a second part is fastened and joined to the display structure in the inner part. A third part may be present for further fastening and joining to the display structure in the inner part. The joining methods between the cover and jacket to the inner display structure should preferably be by fastening means such as in the form of locking tabs and slots or grooves (hereinafter referred to as a locking tab structure) made of the same material or by hooks and loops or adhesive. The cover and jacket can be folded for storage to occupy less space when not in use, and they can be unfolded when being used.

Thus, a method to cover or wrap a display structure is provided, which comprises of unfolding a cover or jacket which is a replica or partly resembles, the outer shape, particularly the lateral and upper panels of a display structure. These, in part, have a diameter or width slightly larger than that of the display structure. The method further comprises sliding the jacket to embrace the display structure until all the parts of the columns and the tray bases which are facing in a substantially outward direction are covered by means of the jacket or parts of the jacket. This is done by folding at least a second part of the jacket or cover in a substantially inward direction with respect to the display structure in such a manner that the second part embraces and become joined to the display structure by means of, preferably, a locking tab structure, hooks and loops or an adhesive.

In a similar way, a method is also provided for storing a jacket or cover which comprises the steps of uncovering or uncasing a display structure, by separating the at least second part of the jacket or cover of the display structure, outwardly folding the at least second part from the display structure, vertically sliding or unfolding the jacket or cover based on the display structure until the jacket or cover has been completely separated from the display structure, and folding the jacket or cover for storage.

Thus, an objective of the present invention is to provide a jacket or cover for display structures which dress the display structure.

Furthermore another objective of the present invention is that the jacket or cover be easily mountable and un-mountable from the display structure.

Yet another objective of the invention is to provide a jacket or cover for display structures with predetermined shapes and sizes.

A further objective of the invention is to provide a method to dress, jacket or cover a display structure; and in similar fashion, a method to un-dress, un-jacket or uncover a display structure as well as providing the storage of the cover or jacket.

Another objective is to provide a jacket which may be easily folded for storage or transportation.

Other objectives and advantages of the present invention will become evident when referred to along with the description of the drawings.

BRIEF DESCRIPTION OF THE FIGURES

The particular features and advantages of the invention, as well as other objectives of the invention, will become evident through the following description, taken into consideration with the attached drawings, where.

DETAILED DESCRIPTION OF THE INVENTION

The present invention comprises a cover or jacket 1 for mountable display structures 20. Specifically, the jacket 1 for display structures has been devised to attract consumers' attention and at the same time to provide protection to the display structure 20 and to be set up in a speedy manner. A further advantage of the jacket 1 is that the same display structure 20 can be used multiple times for different products, with advertising or highlighting attention to different products with different jackets. A further advantage of the jacket 1 is its foldable structure, hence its storability.

Figure 1:
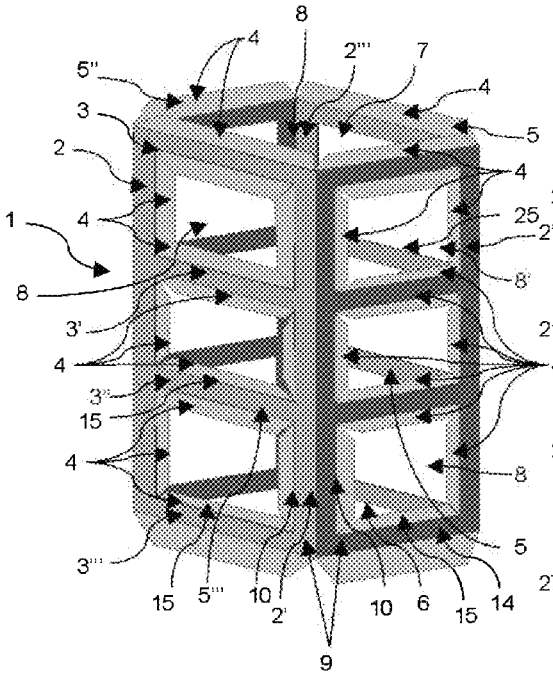
FIG. 1 is a conventional perspective view of the jacket of the present invention.
Figure 2:
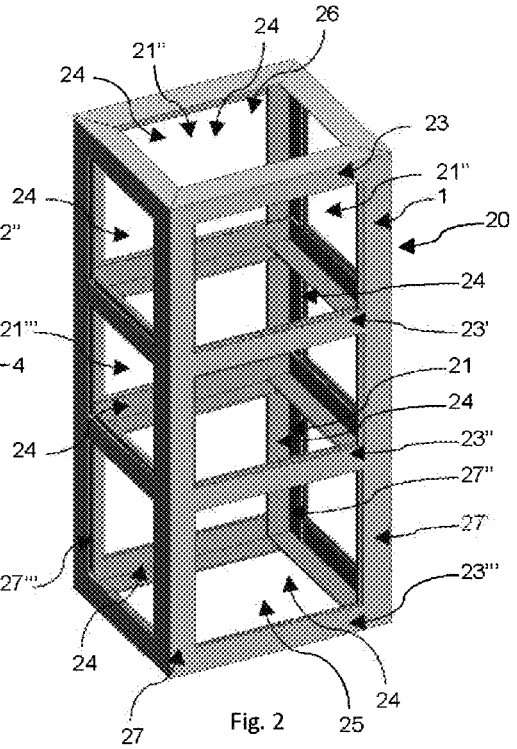
FIG. 2 is conventional perspective view of the jacket of the present invention covering a display structure.
Figure 2A:
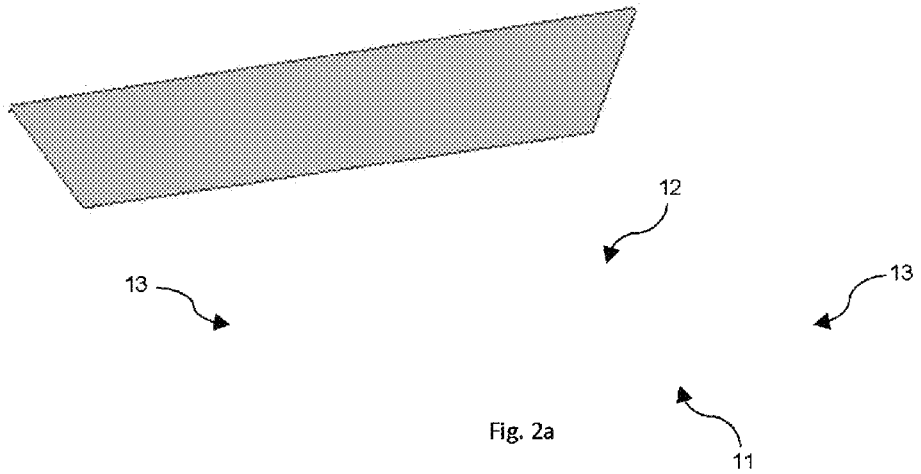
FIG. 2*a* is a detailed view of a flap of the jacket of the present invention.

The following description is with respect to FIGS. 1 and 2. The drawings and the present description should not be construed as limiting the shape of the cover or the jacket 1 or the display structure 20 to merely the determined shapes shown and disclosed. The drawings are provided as examples, and possibly, as the preferred example by the applicant.

The cover or jacket 1, such as is shown in FIG. 1, may replicate the shape of a display structure 20. That is, it is common that the display structures 20 have the shape of tetrahedrons, pentahedrons, hexahedrons, octahedrons, dodecahedrons, icosahedrons, icosidodecahedrons, rombic triacontahedrons, elongated pentagonal cupolas, octagonal prisms, deltahedrons, stellated polyhedrons and zonohedrons among others; as well as cylindrical shapes. More commonly, they are tetrahedrons or hexahedrons, and from among these, the triangular prisms, cuboids or cubes are preferred. Additionally, it is common regarding display structures 20, that at least one panel 21, and preferably all four panels 21-21''' not be completely solid. That is, it is preferable that the lateral panels 21-21''' have at least one window 24. Preferably, the window has a width such, that it is equivalent to that of the one between a first column 27 and a second column 27' co-lineal with the first column 27, and that its height is preferably equivalent to that of the one between the first tray base 23 and a second tray base 23', proximate to the first tray base. The at least one window 24 allows the consumer to be able to grab the product in the display structure 20. It is desirable to keep the area of the window as large 24 as possible (the longest and widest possible) in order to allow the consumer easy access to the product. Additionally, it is preferable that all panels 21-21''' have at least one window 24 to ensure access to the product from several vantage points. The lower side 25 of the tray can be or not be solid. Similarly, the upper side 26 of the tray can be or not be solid. However, it is preferable that the upper panel 26 have a window 24, where the window has a width such that it is equivalent to that between a first side of the tray base 23 and a second side of the tray base 23, opposite to the first side of the tray base 23. This allows the consumer to have access to the display structure 20 from the upper part of the display structure 20.

As was mentioned before, the jacket 1 has a similar shape or partly replicates the display structure 20. Specifically, similar to the display structure, the jacket 1 has at least one lateral panel 5-5''' formed by at least two parts of column 2-2''', parts of tray base 3-3'' and flaps 4-4'. The flaps 4-4', when in a folded position, provide support to the display structure 20. In a folded position, the jacket 1 may have its lateral panels 5-5''' at different angles. That is, as previously mentioned, the shape of the cover or jacket 1 will depend on the shape of the display structure 20. As an example, should the display structure 20 be like the one shown in FIG. 2, that is, cuboid shaped, then each of the lateral panels 5-5''' of the jacket, upon being unfolded, shall be set substantially perpendicular to each other. For example, as is shown in FIG. 1, the lateral panel 5 is in a substantially perpendicular position to the lateral panel 5'. Similarly, the jacket is formed by a lower panel 6 and an upper panel 7, where both the lower panel 6 and the upper panel 7 are completely hollow. Replicating the display structure 20, each of the lateral panels 5-5''' has at least one window 8, preferably with a width such that it is slightly less than the width of the window 24 of the display structure, and preferably with a length such that it is slightly less than the width of the window 24 of the display structure. The at least one window 8 allows the consumer to stretch through the jacket 1 and through the display structure 20, in order to reach for a product within the display structure 20. The jacket or cover 1 preferably has a window 8 per each window 24 of the display structure 20. Furthermore, the number of lateral panels 5 will depend on the shape of the display structure. Therefore, in this embodiment, at least three panels 5 are required. Likewise, the number of column parts 2 will depend on the shape of the display structure. Therefore, in this embodiment, at least three column parts are required.

Each of the parts of column 2-2''' has a shape similar to that of the outer part of the column 27 of the display structure. For example, the part of column 2-2''' as shown in FIG. 1 has two panels 9, 9' which are substantially perpendicular to one another when the jacket is in a mounted position. However, this shape can change depending on the number of sides which the display structure 20 has. The parts of column 2-2''' have substantially similar length, and are slightly longer than that of the column 27 of the display structure. Similarly, both panels 9, 9' have a substantially similar width, and are slightly larger than that of the column 27 of the display structure. Along the length of each panel 9, 9', that is, along the length of both parts of the part of column 2-2''' some flaps 4 are attached.

Each of the parts of the tray base 3-3''' has a similar shape to that of the outer part of the tray base 23-23''' of the display structure. For example, the tray base part 3-3''' has a panel 14 in a substantially vertical plane. The panels 14 of the tray base parts 3-3''' have a substantially similar length, and slightly longer than those of the outer panel, that is, than the panel in a substantially vertical plane of the tray base 23. The panels 14 of the parts of the tray base 3-3''' have a substantially similar width relative to those of the outer panel of the tray base 23. Along the length of each panel 14, both on the upper part as well as on the lower part of said panel, some flaps 4 are attached. The flaps 4 attached at each of the parts of column 2-2''' are positioned in a substantially vertical plane, while the flaps 4 attached at each of the parts of the tray base 3-3''', are set in a substantially horizontal plane.

Each flap 4 has, a first part 11 which has a length similar to that of the inner frame 10, 15 of the window 8. A second part 12 at the opposite end of the flap 4 relative to the first part 11, has a shorter length. The first part 11 abuts with the tray part 3-3''' or the column part 2-2'''. Additionally, each flap 4 has its lateral borders 13 tilted towards the center of the flap 4, in such a way that each flap 4 has a substantially trapezoidal shape, and more specifically a substantially isosceles trapezoidal shape. The above shape makes it possible to correctly fold the flap 4 towards the inner part of the display structure 20 when the cover or jacket 1 is mounted onto the display structure 20. That is, this shape of the flap 4, when folded towards the inner part of the display structure, does not interfere with the borders of the parts of column 2-2''' of the cover or jacket, nor with the columns 27 of the display structure. Furthermore, the above shape allows the correct unfolding of the flap. It is preferred that each flap 4 in the parts of column 2-2''' be foldable towards the inner part of the jacket 1 or display structure 20, but not foldable towards the outer part of the cover or jacket 1 or the display structure 20. Therefore, an outwardly facing groove may be provided in the inner face of the panel between the edge of the flap 4 and the corresponding column part 2-2''', or tray base part 3-3''', to facilitate the folding of the flaps 4 towards a generally inward direction relative to the display structure 20. Additionally, the above mentioned configuration allows for a larger contact area of the flap 4 with the inner part of the display structure 1, as will be further explained, without interfering with the borders of the parts of column 2-2''' of the jacket 1 and with the columns 27 of the display structure during the folding. However, it can be foreseen that both the first part 11 and consequently the second part 12 of the flaps have a smaller size. Specifically, it is preferred that the size of the first part 11 be at least 60% of the length of the inner frame 10, 15 of the window 8, and more specifically, at least 75% and even more preferably at least 80% of the length of the inner frame 10, 15 of the window 8.

The flaps 4 have at least two portions, which when folded, a first portion has a generally outwardly direction and a second portion has a generally inwardly direction. When the jacket 1 is in mounted position, the second portion is folded until its inner face abuts an inner part of the display structure 20 in a substantially vertical plane of both the column as well as the tray base of the display structure, respectively for each of the flaps—vertical and horizontal flaps. Thus, once folded, the first portion generally faces in an outwardly direction relative to the display structure 20, and being visible to the consumer, while the second portion generally faces in an inwardly direction relative to the display structure 20, and being visible to the consumer only when the tray base is substantially free of displayed products. Thus, decorating the first portion of each flap 4, as well as the second portion of each flap is recommended.

On the other hand, the second portion of each flap 4 must have fastening means to the inner panel of the display structure 20 relative to both the column 27 as well as the tray base 23 of the display structure. Preferably, the fastening means are a locking tab structure or hooks and loops, such as Velcro® or adhesive means.

Figure 2B:
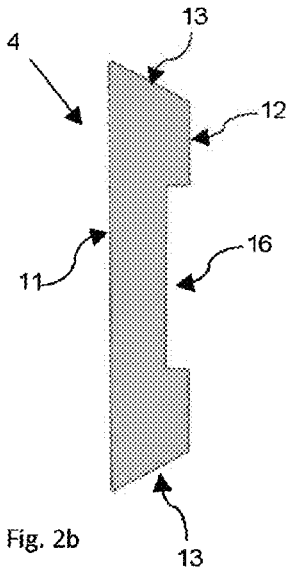
FIG. 2*b* is a detailed view of a flap with a groove of the jacket of the present invention.
Figure 2C:
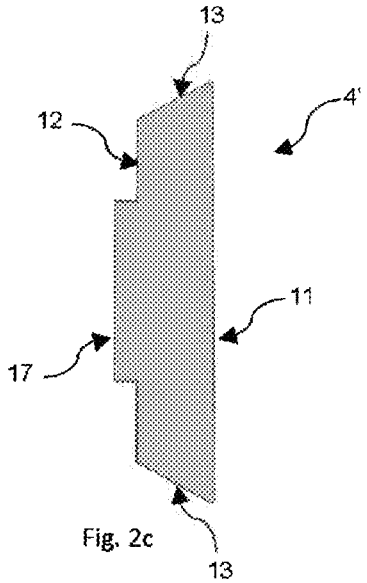
FIG. 2*c* is a detailed view of a flap with a protuberance of the jacket of the present invention.

For the locking tab structure as fastening means, such as can be seen in figures from 2*b* thru 2*e*, it is necessary that on the second part 12, specifically along the length of the second part 12, there be a groove 16 or open slot, a protruding element or tab 17 or a combination of grooves 16 and protruding elements 17. When the flaps 4 are in a substantially vertical direction, similar to those shown in FIGS. 2*b* and 2*c*, it is preferred that these vertical flaps 4 have a single groove or protrusion 17. On the other hand, when the flaps 4 are set on a substantially horizontal direction, as those shown in FIGS. 2*d* and 2*e*, it is preferred that the substantially horizontal flaps 4 have a combination of grooves 16 and protrusions 17 along the length of the flap 4. When there is a groove 16 in a first flap of a window 8, for example a first horizontal flap 4 of a first window 8, then there must be a protrusion 17 in the opposite direction, that is, a first horizontal flap 4 of a second widow 8', wherein the flaps of the two windows 8, 8' are proximate to each other. In the case of horizontal flaps 4 for example, when an upper or a lower flap 4 have a combination of "groove-protrusion-groove", on the opposite lower or upper flap 4' there should be a combination of "protrusion-groove-protrusion". This is set in such a way that a groove 16 always has an opposing protrusion 17, and that the protrusion 17 always have a groove 16 opposite to it so that the protrusion may be locked with the groove to form a locking tab structure.

Figure 2D:
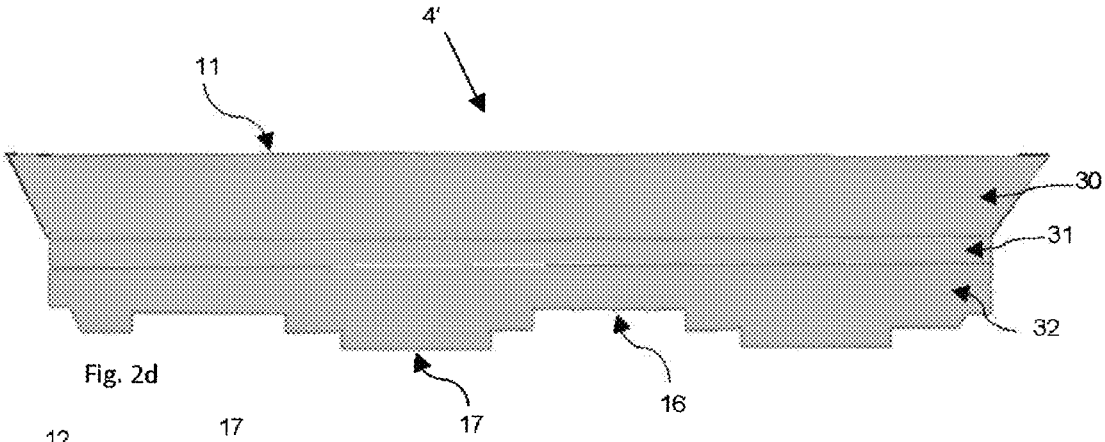
FIG. 2*d* is a detailed view of a first flap with grooves and protuberances of the jacket of the present invention.
Figure 2E:
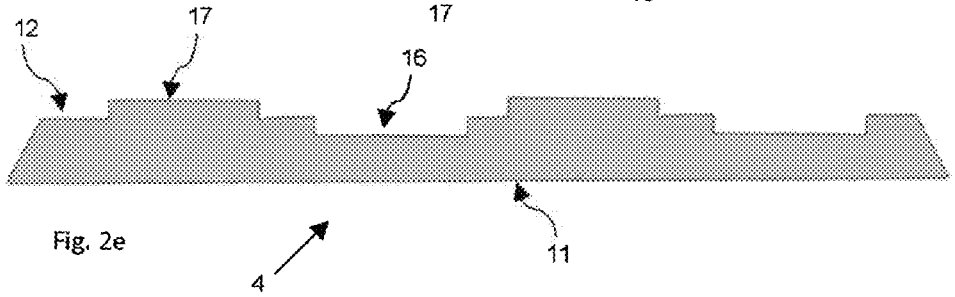
FIG. 2*e* is a detailed view of a second flap with grooves and protuberances of the jacket of the present invention.

Some of the flaps 4 may be composed of at least three portions. For example, in two opposing flaps which are proximate to each other in different windows, a first flap (FIG. 2*d*) may comprise the following. The first portion 30 whose lateral borders 13 have an inclination as described above, is joined to the inner face of the tray base 3, wherein the first part 11 of the first portion 30 abuts with the upper part or lower part of the tray base, while the second part 12 of the first portion abuts with the lower part of the inner face of the tray base. Furthermore, the first portion 30 abuts a first side of second portion 31 by means of the second part 12. The second portion 31 has a lesser width than the width of the first side, the length of the second portion 31 being of similar length relative to the length of the second part 12 of the first portion 30. The second portion 31 is joined, on the opposite side to the first portion 30, to a third portion 32, which is on the border opposite to the joint between the second portion 31, and the third portion 32. The third portion 32 has a combination of grooves 16 and protrusions 17. The second flap 4 (FIG. 2*e*) may be comprised of only a first portion, wherein the first portion is tilted, as disclosed above, wherein first part 11 has a greater length than the second part 12, and wherein the second part will abut, by means of grooves and protrusions, with the protrusions and grooves of the third portion 32 of the first flap (FIG. 2*d*). Each of the borders between the portions 30, 31, 32, as well as each of the borders between the parts of column 2, and the parts of the tray base 3 to the flaps 4, is foldable in such a way that the groove(s) 16 of a first flap 4, when folded, is (are) found in close proximity to the protrusion element(s) 17 of the opposite flap 4', as above explained. More specifically, the folding is such that the protrusion element 17 can be inserted into the groove 16, and entwined between the protrusion elements 17 and the grooves 16. This allows the flaps 4 to remain securely hidden from the consumer's view, unless products are removed from the display structure.

Alternatively, for the hooks and loops such as Velcro® as fastening means, a first strip of either hooks and loops must be glued with an adhesive, preferably of a similar length to that of the inner panel of the flap 4. On the other hand, a second strip of the opposite cooperative element, that is loops or hooks, must be glued with adhesive, with a similar size to that of the first strip, on the inner vertical panel of the corresponding tray base 23 or column 27 of the display structure 27. Finally, and in an alternative manner to either of the two previously mentioned fastening expedients, which are preferred, the inner panel of the flap 4 is provided with an adhesive, and optionally with a layer of waxed paper, so that when the waxed paper layer is removed and the flap 4 is folded, the flap 4 can be adhered to the inner vertical panel of the corresponding tray base 23 or column 27 of the display structure.

In an unfolded but not mounted position of the cover or jacket 1, the vertical and horizontal flaps 4 are positioned at about at 180° relative to the parts of column 2-2''' and to the tray base parts 3-3''' respectively. In an unfolded and mounted position of the cover or jacket 1, the vertical and horizontal flaps 4 are at about 360° or at about 0° to the parts of column 2-2''' and the parts of the tray base 3-3'''.

With reference to FIGS. 3 thru 8, a process of unfolding and mounting of the cover or jacket 1 of a display structure 20 is shown.

Figures 3, 4, 5, 6, 7, 8:
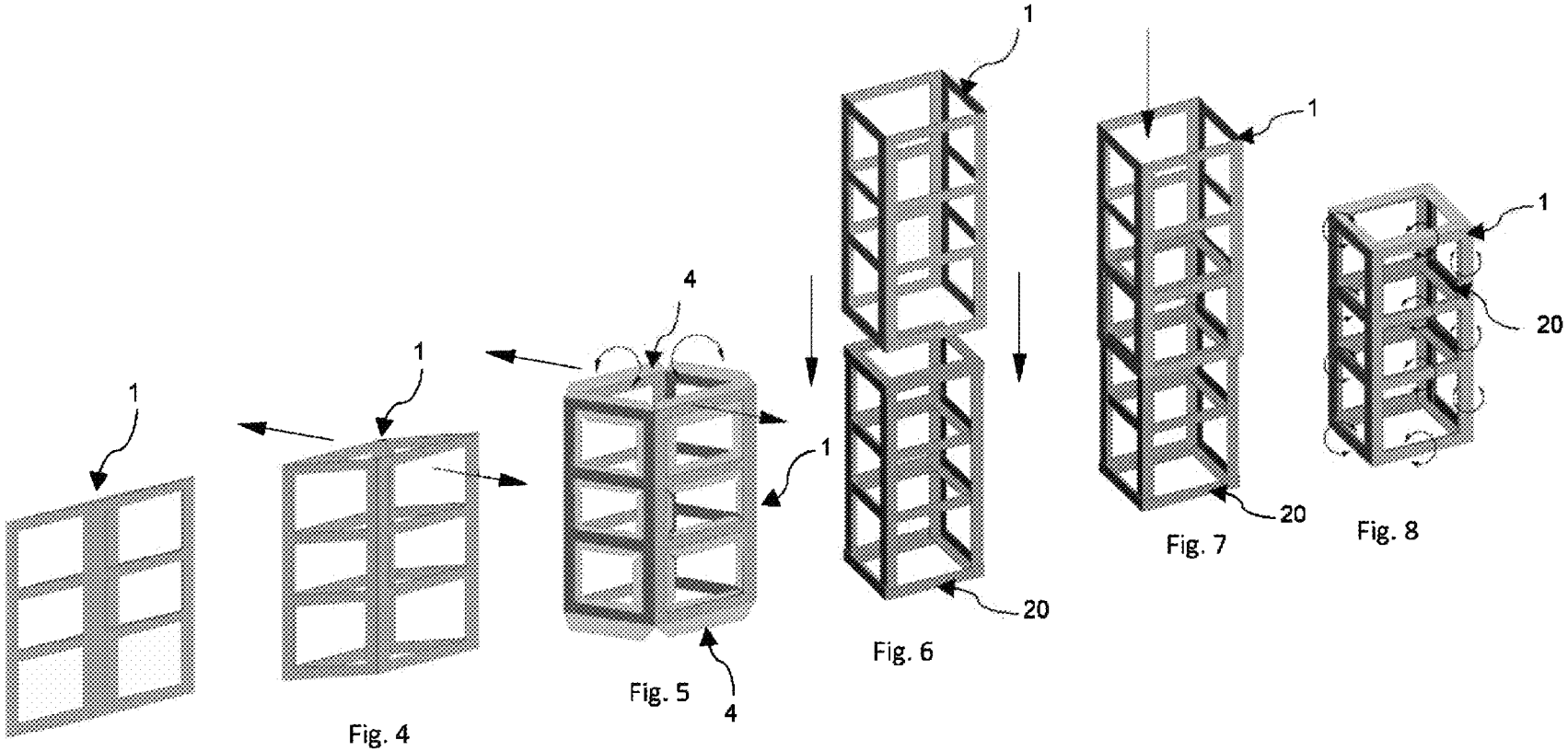
FIG. 3 is a conventional perspective view of the jacket folded for its transport or storage.
FIG. 4 is a conventional perspective view of a first step to cover a display structure with the jacket of the present invention.
FIG. 5 is a conventional perspective view of a second step to cover a display structure with the jacket of the present invention.
FIG. 6 is a conventional perspective view of the third step to cover a display structure with the jacket of the present invention.
FIG. 7 is a conventional perspective view of a fourth step to cover a display structure with the jacket of the present invention.
FIG. 8 is a conventional perspective view of a fifth step to cover a display structure with the jacket of the present invention.
Figure 9:
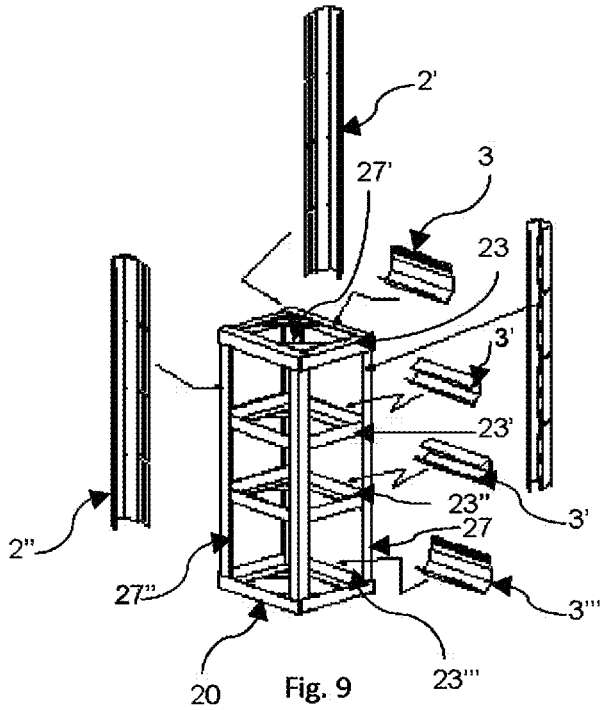
FIG. 9 is a conventional perspective view of a first embodiment of the jacket of the present invention.
Figure 10:
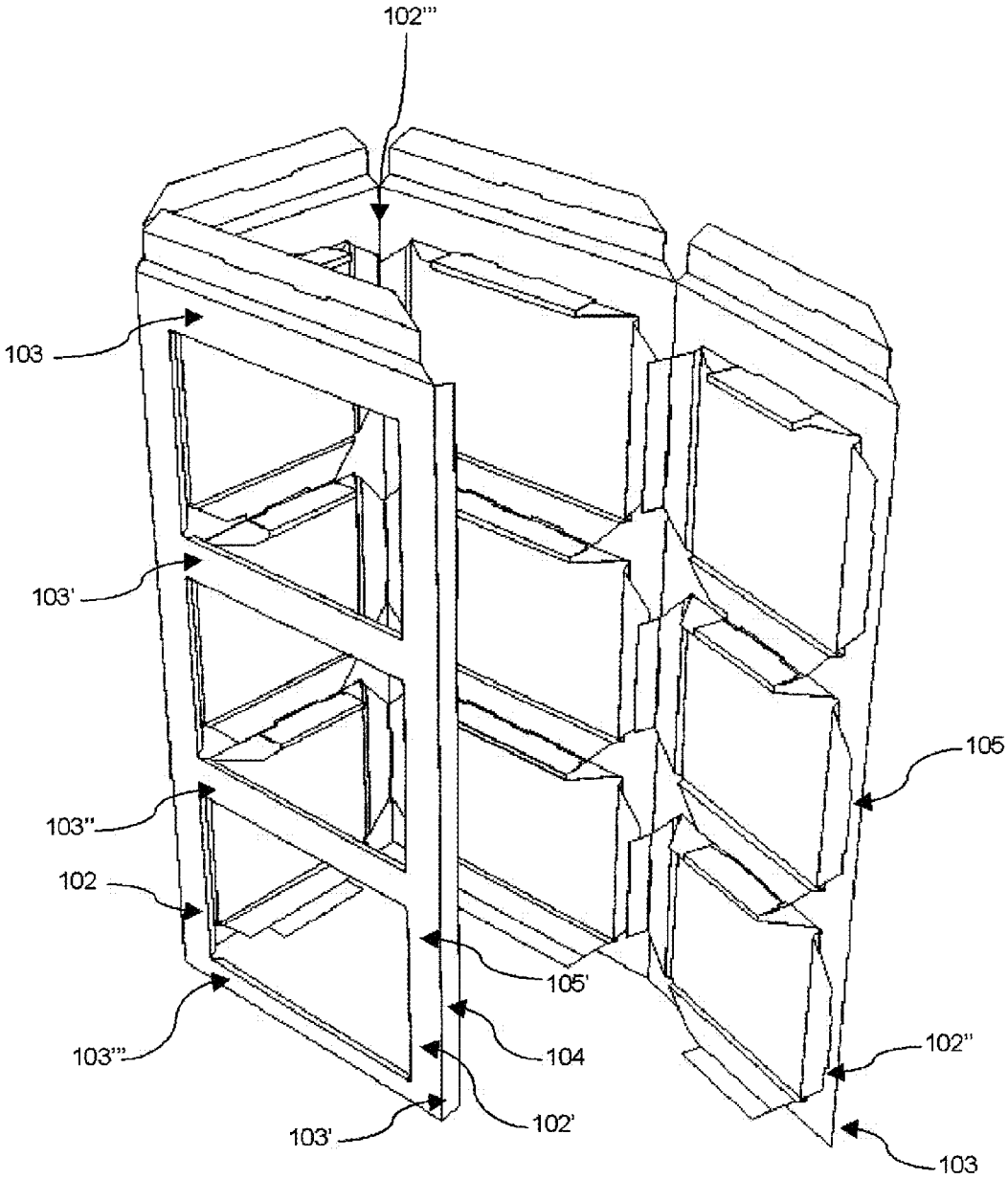
FIG. 10 is a conventional perspective view of a second embodiment of the jacket of the present invention.
Figure 11:
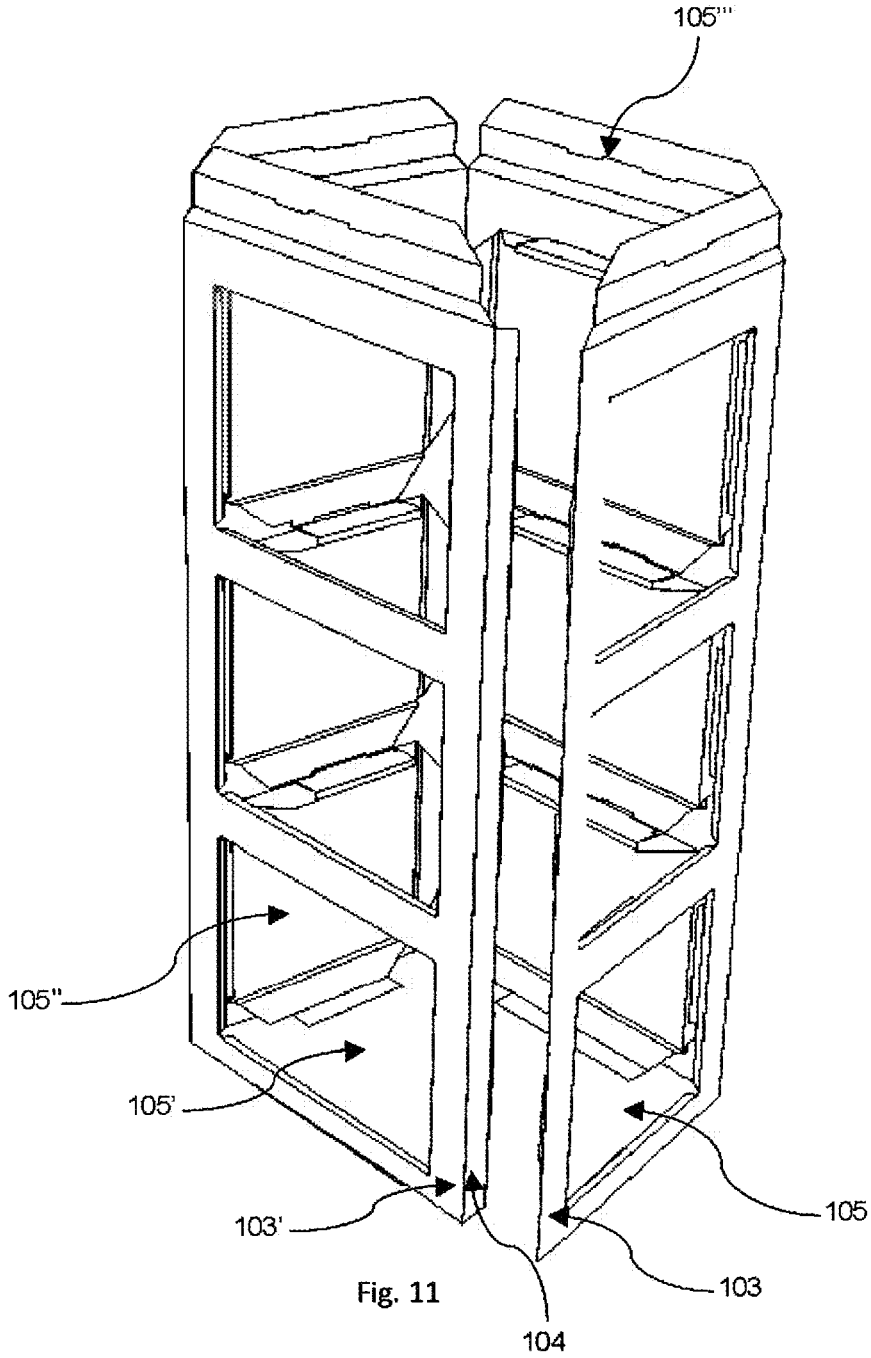
FIG. 11 is a conventional perspective view of the second embodiment, in a position for mounting the jacket with a display structure.
Figure 12:
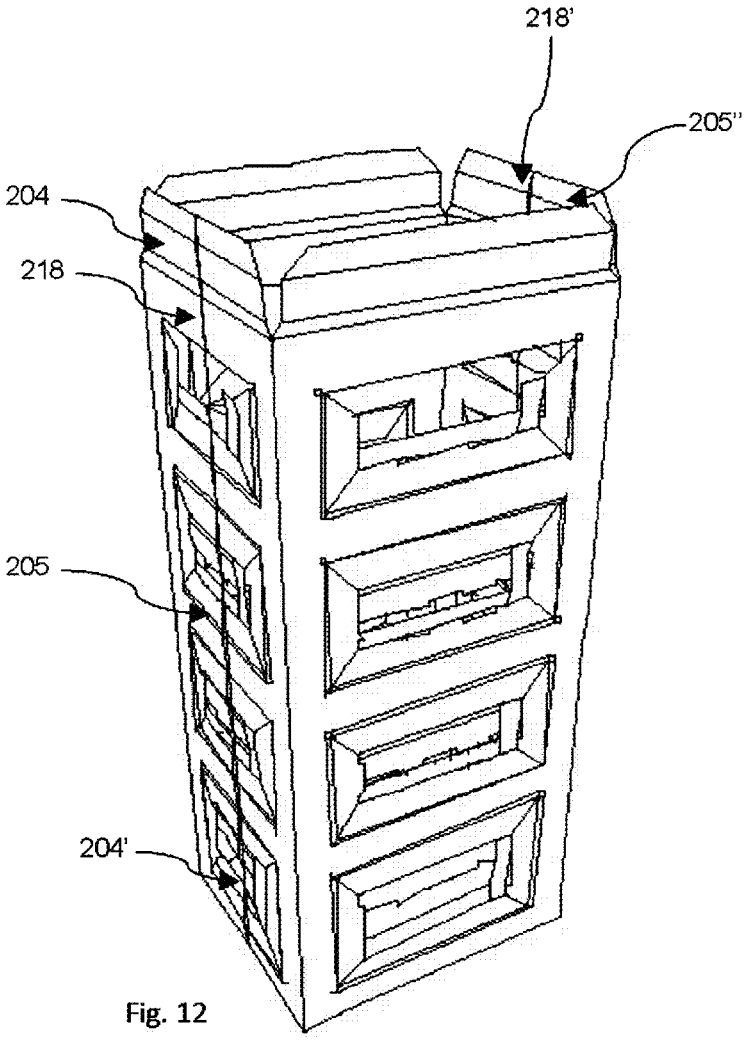
FIG. 12 is a conventional perspective view of a third embodiment.
Figure 13:
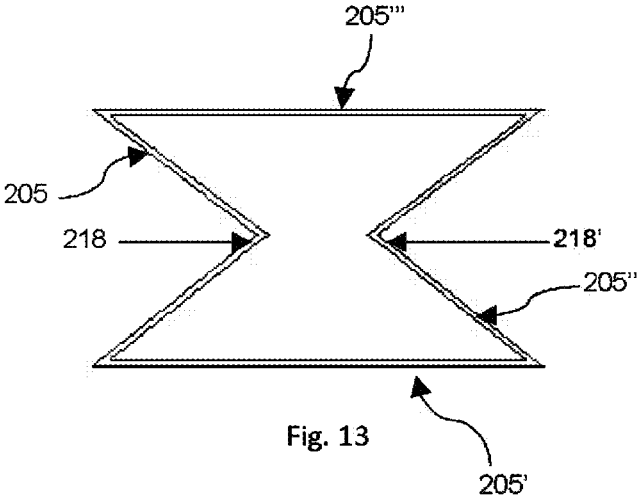
FIG. 13 is an upper view of the third embodiment, when the third embodiment is being folded.
Figure 14:
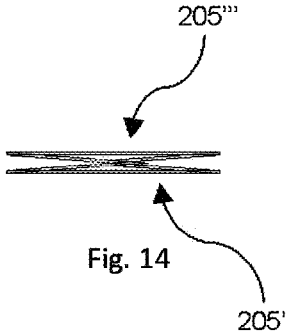
FIG. 14 is an upper view of the third embodiment, when the third embodiment is folded.

Initially, just as is shown in FIG. 3, the jacket 1 is folded in such way that at least two panels 5-5''' are generally oriented in the same direction; that is, when the jacket 1 is folded, a first panel 5 is joined with and substantially parallel to a second panel 5'. In one embodiment, the third panel 5'' is joined with and is substantially parallel to the fourth panel 5'''. However, the first panel 5 and the third panel 5'' are not parallel, but are rather substantially in series; the second panel 5' and the fourth panel 5''' are not parallel either, but are rather in series. The above described process allows for two parts of columns 2, 2'' to be near each other. Also, the flaps 4 are folded towards the inner part, in such a way that the flaps 4 abut, respectively, the inner panel of the parts of column 2-2''' and the parts of tray base 3-3''', that is, the flaps 4 are folded upwardly or downwardly, depending on the standing position of the cover or jacket 1. A first embodiment for folding the jacket is shown in FIG. 9 and will be explained below. A second embodiment for folding the jacket is shown in FIGS. 10 and 11 and will be explained below. A third embodiment for folding the jacket is shown in FIGS. 12-14 and will be explained below. Therefore, to fold the jacket as is described above, an outwardly facing groove may be provided in the inner face of the panel between the edge of each of the panels 5-5'''. This will facilitate the folding of the display structure.

Afterwards, as is shown in FIG. 4, the jacket 1 is unfolded. The procedure to unfold it is by separating both parts of column 2, 2'' which are proximate, so that said column parts 2, 2''' become distant. The jacket 1 is unfolded until achieving a similar figure to that of the display structure 20. The second step for the first, second and third embodiments will be explained below.

Afterwards, as is shown in FIG. 5, the flaps 4, in each part of column 2-2''' and in each part of tray base 3-3''' are unfolded until they reach approximately a 180° position relative to the parts of column 2-2''' and the parts of tray base 3-3'''. At this point, the cover or jacket 1 is totally unfolded and ready to be mounted onto the display structure 20. This step may be similarly applied for the first, second and third embodiments.

Given that the width or diameter of the jacket 1 is slightly greater than the width or diameter of the display structure 20, the jacket 1 can slide with embracing of the display structure 20, as seen in FIGS. 6 and 7. In this way, the jacket or cover 1 acts as a surrounding device or a ring relative to the display structure 20. The jacket 1 is slid until all the columns 27-27''', and at least some of the tray bases 23-23''', of the display structure are covered with one part of column 2-2''' and one part of tray base 3-3'''. Alternatively, the jacket is slid until at least part of the columns 27-27''' and part of the tray bases 23-23''' of the display structure are covered by some of column parts 2-2''' and some of tray base parts 2-2''' respectively. A half jacket or cover 1 can therefore be provided for the upper part of the display structure 20 and half jacket 1 for the lower part of the display structure 20, to thereby provide two different colors, or to promote two different articles in a same display structure 20. The covering step for the first, second and third embodiments will be disclosed below.

When the jacket or jackets 1, cover the desired areas of the display structure 20, the flaps 4 are folded until the inner face of the first portion abuts with the inner face, in a substantially vertical plane of the tray bases 23-23''', or of the columns 27-27''', respectively. The second portion 31, if applicable, is then folded in a substantially inwardly orientation, whereas the third portion 32, if applicable, is folded in a substantially downwardly direction. Grooves, as above disclosed may be provided for easily folding the flaps. The flaps 4 are kept in position given that the second part 12 of the first, second or third portion of the flaps 4 have fastening means such as a locking tab structure, hooks and loops or an adhesive means, as was previously explained, and the matching corresponding flap has fastening means such as locking tabs and slots or grooves, loops and hooks or adhesive means. When the flap 4 is joined to the inner panel in a substantially vertical plane relative to the tray bases 23-23''' and to the columns 27-27''', respectively, the trays (not shown) are mounted onto the display structure 20 and the products (not shown) are placed over the trays. The unfolding step of the flaps applies in a similar manner in the first, second and third embodiments.

First Embodiment

In an alternative manner, as is shown in FIG. 9, the parts of column 2-2''' may be provided separate from each other. Similarly, the parts of tray base 3-3''' can also be provided in a way which makes them independent from each other, as well as independent from the parts of column 2-2'''. In this way, the cover or jacket 1 is set to allow mounting with separate pieces.

Thus, according to FIG. 9, a part of column 2 is placed near a column 27 of the display structure, in such a way that the part of column 2 abuts with the column 27. When the part of column 2 covers the desired part of the column 27, the flaps 4 of the part of column 2 are folded until they abut with the inner panel in a substantially vertical plane of the columns 27. The flaps 4 are kept in position given that the flaps 4 have fastening means, such as a locking tab structure, hooks and loops or adhesive, such as was previously explained. Similarly, a part of tray base 3 is joined to a tray base 23 of the display structure, in such a way that the part of tray base 3 abuts with the tray base 23. When the part of tray base 3 covers the desired part of the tray base 23, the flaps 4 of the part of tray base 3 are folded until they abut with the inner panel in a substantially vertical plane of the tray base 23. The flaps 4 are kept in position given that the flaps 4 have fastening means, such as locking tabs and slots or grooves, hooks and loops, or adhesive as was explained above. This procedure is carried out in all the additional parts of column 2'-2''' in their respective columns 27-27''', and in all the additional parts of tray base 3-3''' in their respective tray bases 23-23'''. When the flap 4 is fastened to the tray bases 23-23''' and the columns 27-27''', respectively, the trays (not shown) are mounted onto the display structure 20, as well as the products (not shown) are placed in the display structure.

Second Embodiment

The following is with reference to FIGS. 10 and 11. The second embodiment is similar to the invention above disclosed, wherein all the tray base parts 3-3''' and column parts 2-2''' are joined in a single jacket structure. The flap construction is essentially the same as in the above inventions. However, while in the above invention where all the tray base parts 3-3''' and column parts 2-2''' are joined at their ends to form the jacket structure and all panels 5-5''' abut each other when in an unfolded position and are joined by the lateral ends, the second embodiment, when unfolded has at least two lateral ends 103, 103' of two different panels 105, 105' which are not joined. When unfolded, the different panels do not necessarily abut each other however when folded, the two panels 105, 105' abut each other and are in a substantially perpendicular relation as in the embodiment above disclosed.

Therefore, at least one end of panel 105 may be separated from the corresponding abutting end when folded with the second panel 105' providing an opening to the inner part of the jacket 1. At least one of the two panels 105, 105', which may be separated when unfolded, may have an additional flap 104 proximate to the end 103' which may run the entire height of the jacket 1, thus being similar to the height of the two panels 105, 105'. However, different heights may be provided. For example, two separate flaps 104 may be provided along the end 103', a first for the lower part of the jacket and the second for the upper part of the jacket. The panels 105, 105', which are separate, may be joined by means of said flap 104. When in a position to mount the jacket in the display structure, the flap 104 should abut the column of the display structure, while the column part 102" of the panel should abut with the flap 104. Thus, the flap is between the display structure and the column part 102" of the panel 105. Therefore, the two ends 103, 103' should be in an abutting relationship when the jacket 1 is in a position to be mounted. The flap may have any fastening means such as adhesive or hooks and loops such as Velcro®. If the latter fastening means is chosen, then at least part of the inner face of the panel 5, proximate to the column part 2''', should have corresponding loops or hooks.

To mount the jacket 1, instead of sliding the jacket 1 embracing the display structure 20, as shown in FIGS. 6 and 7, the jacket may surround the display structure 20. Once the flaps 4 have been unfolded, and once at least two panels 105'-105''' overlap with the faces of the display structure, the last panel 105 may completely surround the display structure 20. Thus, the jacket acts as a surrounding or embracing device or a ring conforming to the display structure 20. When the panel 105 completely surrounds the display structure, the end 103 of the inner face of the panel 105 abuts with the flap 104, and the fastening means allows fastening the end 103 by its inner face and the flap 104. This results in fixing the faces of the jacket in a fixed relation so as to embrace the display structure.

A greater number of stored jackets may be achieved with this configuration.

Third Embodiment

The following is in reference to FIGS. 12 through 14. The third embodiment is similar to the invention above disclosed, wherein all the tray base parts 3-3''' and column parts 2-2''' are joined in a single jacket structure. The flap construction is essentially the same as in the above inventions. Furthermore, in this embodiment all the panels 5-5''' may be joined in a single jacket 1 structure, and hence may slide to surround the display structure 20, as above disclosed. In at least one of the lateral panels 205, at least one folding line 218 is present, which is substantially centered with respect to the panel 205 and which runs from the upper end of the uppermost flap 204 in the panel 205 to the lower end of the lowermost flap 204' in the panel 205. If the jacket corresponds to a hexahedron, as shown in the figures, preferably two panels 205, 205" have the at least one folding line 218 along their height, including along the corresponding upper flap 4 and the corresponding lower flap 4.

The folding lines 218, 218' allow folding of the panels 205, 205" in a substantially inwardly direction as shown in FIG. 13, while the other two panels 205', 205''' remain unfolded. Thus, at least two panels 205, 205" are divided into halves if there is only one folding line 218, 218' present per panel, as shown. It is preferred that at least one of the two folding lines 218, 218' is partially de-centered with respect to the respective panel 205, 205", so that when folding the panels 205, 205" in an inwardly manner said faces do not abut each other along their folding line 218, 218' when the jacket 1 is in a folded position, as shown in FIG. 14. As for other embodiments, the folding lines 218, 218' may be defined in the inner face of the jacket with a substantially outwardly facing groove in the inner face of the panels 205, 205", to facilitate the folding of the panels 205, 205" towards a generally inward direction with respect to the jacket 1.

A greater number of stored jackets may be achieved with this configuration.

A further folding line (not shown) may be provided. Specifically, a folding line which may be substantially perpendicular to the folding lines 218, 218' may be provided in all the panels 205, 205', 205", 205'''. The folding line for panels 205, 205', 205", 205''' may be substantially centered regarding the height of the jacket structure. Said folding line in the panels 205, 205', 205", 205''' allows folding the jacket structure to a smaller height.

Fourth Embodiment

The following is in reference to FIGS. 19*a* through 21. The fourth embodiment is similar to the third embodiment above disclosed, wherein all the tray base parts 3-3''' and column parts 2-2''' are joined in a single jacket structure. The flap construction is essentially the same as in the above inventions. Furthermore, in this embodiment all the panels 5-5''' may be joined in a single jacket 1 structure, and hence may slide to surround the display structure 20, as above disclosed.

The jacket structure contains at least three substantially vertically running folding lines 318-318" in two opposite panels 305', 305''' when the jacket structure is in a folded position. However two vertically running folding lines 318-318' in two opposite panels 305', 305''' are preferred. When three folding lines are present, a first folding line 318 is proximate to a first end of the panels 305', 305'''; a second folding line 318' is substantially centered with regards to the first and second folding lines 318, 318"; and a third folding line 318" is proximate to a second end of the panels 305', 305''', the second end being opposite to the first end. The first and third folding lines 318, 318" fold the face of the panels 305', 305''' in a substantially inwardly direction, while the second folding line 318' folds the face of the panels 305', 305''' in a substantially outwardly direction. Preferably, one of the two, either the first folding line 318 or the third folding line 318" are more proximate to the second folding line 318' than to the first end or to the second end, respectively. Therefore, when folded, the jacket structure 1 has two panels 305, 305" which remain in a fully extended position, and two panels 305', 305''' which are folded; the two folded panels 305', 305''' have a first and second portion which remain facing in a substantially outwardly direction with regards to the jacket structure 1, and further have a third and fourth portion which abut each other in the inner part of the jacket structure 1. The above disposition allows the jacket structure 1 to have an inner space 320 when the jacket structure 1 is in a folded position.

When two folding lines are present 318, 318' a first folding line 318 is substantially centered with regards to the panels 305', 305''' and a second folding line 318' is between the first folding line 318 and a second end of the panels 305', 305'''. The first folding line 318 folds the face of the panels 305', 305''' in a substantially inwardly direction, while the second folding line 318' folds the face of the panels 305', 305''' in a substantially outwardly direction. Therefore, when folded, the jacket structure 1 has two panels 305, 305" which remain in a fully extended position, and two panels 305', 305''' which are folded; the two folded panels 305', 305''' have a first portion which remains facing in a substantially outwardly direction with regards to the jacket structure 1, and further have a second and third portion which abut each other in the inner part of the jacket structure 1. The above disposition allows the jacket structure 1 to have an inner space 320 when the jacket structure 1 is in a folded position.

When folded, the inner space 320 of the jacket structure 1 allows storing the display structure 20. A display structure similar to those of PCT/IB09/07702 or provisional application 61/437,772 filed on Jan. 31, 2011 from the same applicant may be used. Other folding display structures may be used in the present invention, and the above references are used only as exemplary references and not necessarily as restricting references.

The flaps 4 of at least one panel 305 of the jacket structure, wherein said panel 305 remains in an extended position when said jacket structure 1 is in a folded position, are preferably fixed to the tray bases 23 and the columns 27 of the display structure. That is, in this embodiment, it is preferable that the horizontal flaps 4 of the jacket structure in the panel 305 are fixed to the tray bases 23 of the display structure in the corresponding face of the display structure, while the vertical flaps 4 of the jacket structure in the panel 305 are fixed to the columns 27 of the display structure in the corresponding face of the display structure 20. Therefore, a face of the display structure 20 is in an unmovable or fixed relation with a panel 305 of the jacket structure 1.

As stated above, when both the display structure 20 and the jacket structure 1 are in a folded position, the display structure 20 fits within the jacket structure. The folding lines 318-318" or 318-318' are folded in such a manner that the display structure fits within the jacket structure 1 and more specifically within the first unfolded portion of the folded panels 305', 305'''; furthermore, the folding lines 318-318" or 318-318' are folded in such a manner that at least the third and fourth portion or second and third portion abut each other, and in the case of three folding lines, the second portion is free to allow a second inner space.

To unfold the jacket structure 1 and the display structure 20 from an folded position, the jacket structure 1 is pulled from the opposite panel 305" to that which is fixed by its flaps 4 to the display structure 20, unfolding the two folded panels 305', 305'''. The display structure 20 is then unfolded by pulling the display structure towards the opposite panel 305"; the display structure may be pulled from the windows 8, 24 provided in the jacket structure and display structure, respectively. Once both the jacket structure 1 and the display structure 20 are fully extended, the flaps 4 of the jacket structure may be folded to grip the display structure 20.

Other Aspects of the Invention

Figure 15:
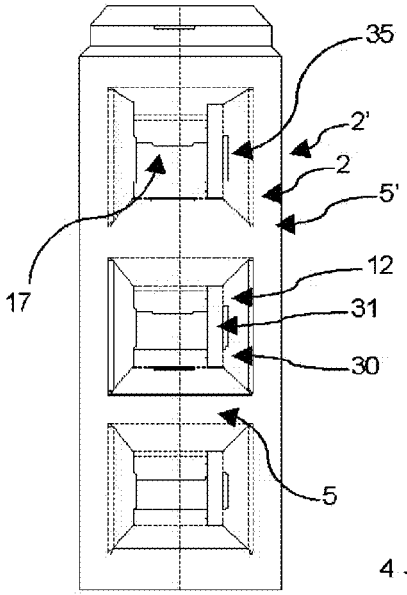
FIG. 15 is a front view of a third embodiment.

FIGS. 15 through **18*j* correspond to the different fastening means available for the flaps 4** of the present invention.

Figure 16:
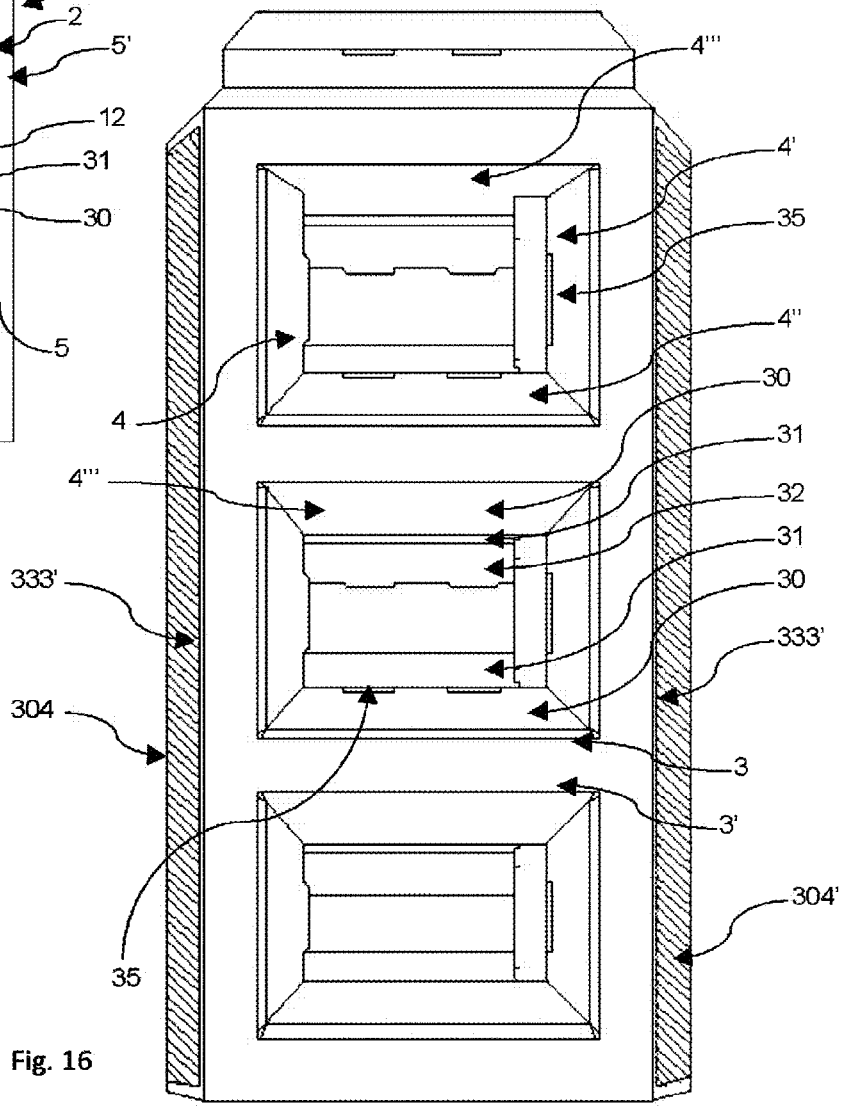
FIG. 16 is a side view of a further embodiment.

For example, for vertical flaps, FIG. 15 shows a first flap 4 having a first portion 30 only, while a second flap 4' has a first portion 30 and a second portion 31. The first portion 30 has the same configuration as above disclosed, as does the second portion 31. In the second flap 4', along at least part the border between the second part 12 of the first portion 30 and the end of the second portion 31 proximate to the second part 12, at least one opening 35 may be found. As shown in FIG. 16, two or more openings 35 may be found along at least part of said border. The protuberances 17 of the first flap 4 may be fitted within such openings 35 so as to form a locking tab structure. That is, when a first panel 5 has a flap 4' containing the first portion 30 and the second portion 31 in a determined column part 2, the corresponding column part 2' which is proximate to and abutting said determined column part 2 in the second panel 5', has a flap 4 containing only the first portion 30 with a protuberance 7. Therefore, when both flaps 4, 4' are folded in an inwardly manner so as to surround a column of the display structure, the protuberance 17 in the flap 4 fits within the opening 35 between the two portions 30, 31 of the flap 4'. Optionally, the inner face, when in an unfolded and mounted position of the second portion 31, may contain fastening means so that said portion 31 is fixed to the jacket rather than being in a moving relation. Likewise, the second portion 31 may have a small width in comparison to the first portion 30 so that the second portion 31 may be in a moving relation with regards to the jacket 1, without compromising merchandise space.

Figure 17:
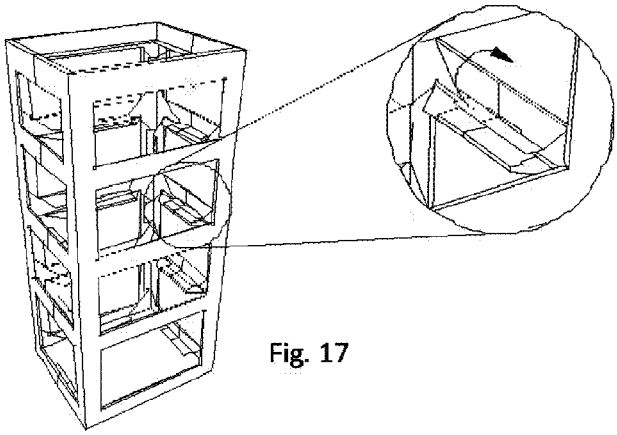
FIG. 17 is a conventional perspective view of the third embodiment and a detailed view of the fastening means.

For example, for horizontal flaps, FIG. 16 shows a first flap 4" having a first portion 30, a second portion 31 and a third portion 32, while a second flap 4''' has a first portion 30 and a second portion 31. The first portion 30 has the same configuration as above disclosed, as does the second portion 31 and third portion 32. In the second flap 4''', along at least part of the border between the second part 12 of the first portion 30 and the end of the second portion 31 proximate to the second part 12, at least one opening 35 may be found. Two or more openings 35 may be found along at least part of said border. The protuberances 17 of the first flap 4" may be fitted within such openings 35 so as to form a locking tab structure. That is, when a first panel 5 has a flap 4'" containing the first portion 30 and the second portion 31 in a determined tray base part 3, the corresponding tray base part 3' which is proximate to and abutting said determined tray base part 3 in the first panel 5, has a flap 4" containing the first portion 30 a second portion 31 and a third portion 32 with a protuberance 7. Therefore, when both flaps 4", 4'" are folded in an inwardly manner, the protuberance 17 in the flap 4" fits within the opening 35 between the two portions 30, 31 of the flap 4'". Optionally, the inner face when in an unfolded position of the second portion 31 may contain fastening means so that said portion 31 is fixed to the jacket rather than in a moving relation. Likewise, the second portion 31 may have a small width in comparison to the first portion 30 so that the second portion 31 may be in a moving relation with regards to the jacket 1 without compromising merchandise space. This locking tab structure system is shown functioning in FIG. 17.

As further shown in FIG. 16 and as a further embodiment, given that the display structure 20 may have multiple panels, the jacket 1 may have flaps 304, 304' similar to the flaps 104 of the second embodiment. These flaps 304, 304' are proximate to and abutting the lateral ends 333, 333' of the panel 305. The flaps 304, 304' may have fastening means such as adhesive or loops and hooks, such as Velcro®, wherein one flap 304 contains loops and the second flap 304' contains hooks. This embodiment may be used independently, that is, for each face of the display structure 20 a single-faced jacket may be provided or may be used in combination with other embodiments, such as the first and second embodiments, to create a combination of different jackets 1, which may have different presentations and colors. Alternatively, it may complement a jacket to complete the jacket structure 1. For example, if the second embodiment jacket structure was used for a hexahedron and the second embodiment jacket 1 is now needed for a heptahedron or octahedron display structure, then the original jacket 1 with four panels 5 is used, and one or two independent faces 305, as shown in FIG. 16, may be used to complement the original jacket 1. From this figure, it should also be noted that the jacket structure 1 may have a combination of different fastening means, such as flaps with locking tabs and slots or grooves and adhesive or Velcro®.

Figure 18A:
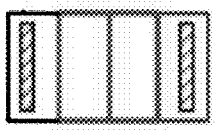
FIG. 18*a* is a front view of part of the jacket and a first embodiment of the fastening means.
Figure 18B:
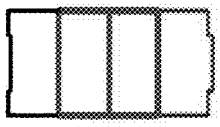
FIG. 18*b* is a front view of part of the jacket and a second embodiment of the fastening means.
Figure 18C:
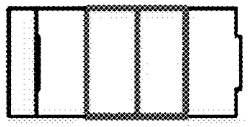
FIG. 18*c* is a front view of part of the jacket and a third embodiment of the fastening means.
Figure 18D:
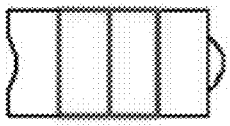
FIG. 18*d* is a front view of part of the jacket and a fourth embodiment of the fastening means.
Figure 18E:
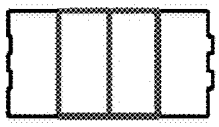
FIG. 18*e* is a front view of part of the jacket and a fifth embodiment of the fastening means.
Figure 18F:
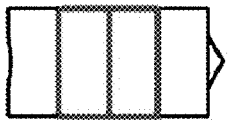
FIG. 18*f* is a front view of part of the jacket and a sixth embodiment of the fastening means.
Figure 18G:
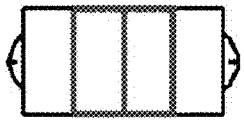
FIG. 18*g* is a front view of part of the jacket and a seventh embodiment of the fastening means.
Figure 18H:
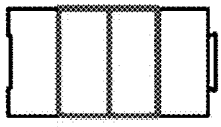
FIG. 18*h* is a front view of part of the jacket and an eight embodiment of the fastening means.
Figure 18I:
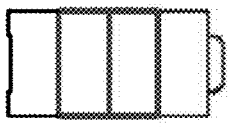
FIG. 18*i* is a front view of part of the jacket and a ninth embodiment of the fastening means.
Figure 18J:
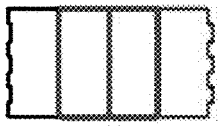
FIG. 18*j* is a front view of part of the jacket and a tenth embodiment of the fastening means.
Figure 19A:
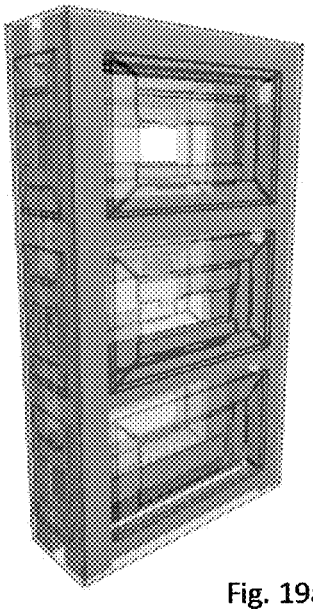
FIG. 19*a* is a conventional perspective view of the jacket in a fourth embodiment, wherein a display structure is stored within the jacket.
Figure 19B:
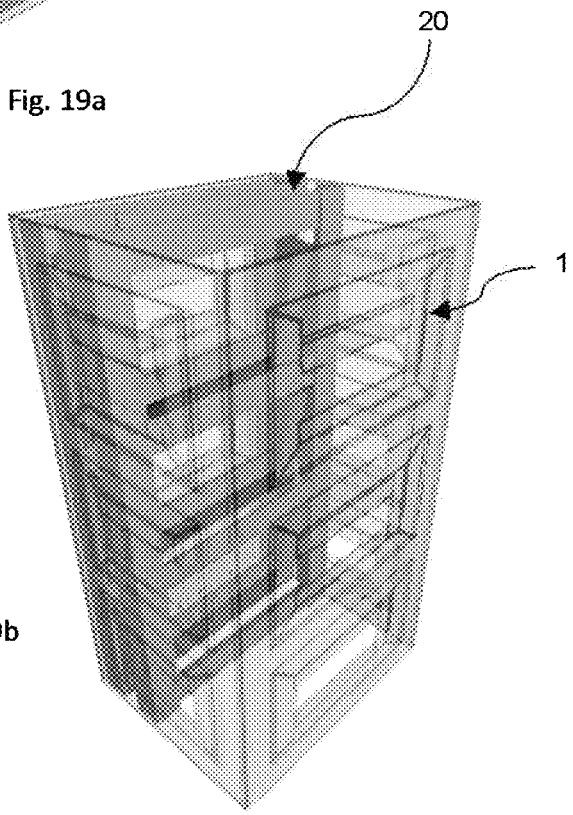
FIG. 19*b* is a conventional perspective view of the jacket in a second step for unfolding the jacket and display structure.
Figure 19C:
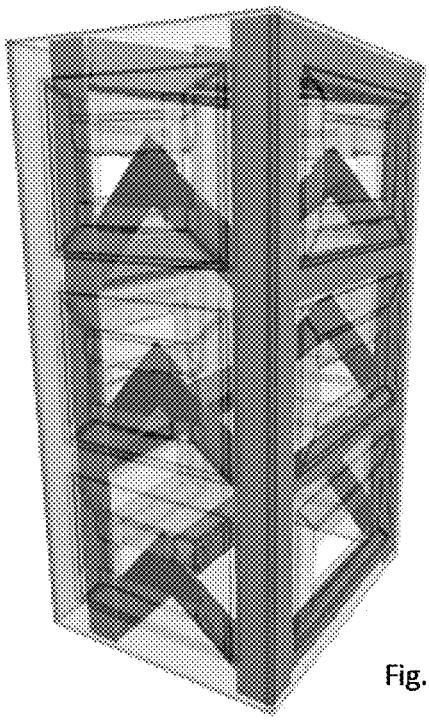
FIG. 19*c* is a conventional perspective view of the jacket in a third step for unfolding the jacket and the display structure.
Figure 19D:
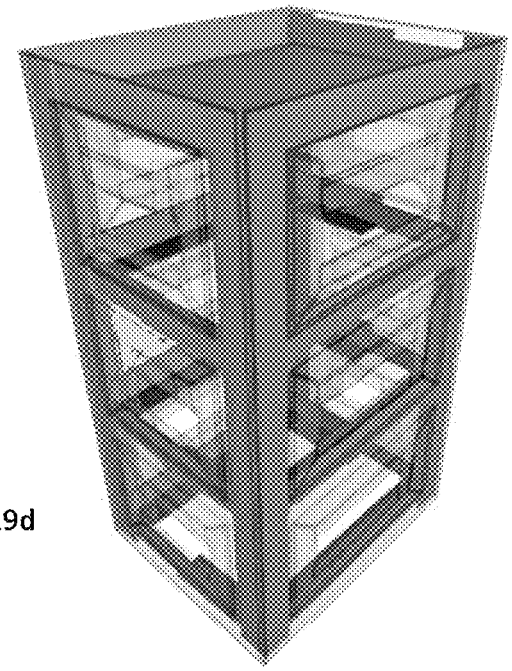
FIG. 19*d* is a conventional perspective view of the jacket in a fourth step for unfolding the jacket and the display structure.
Figure 20:
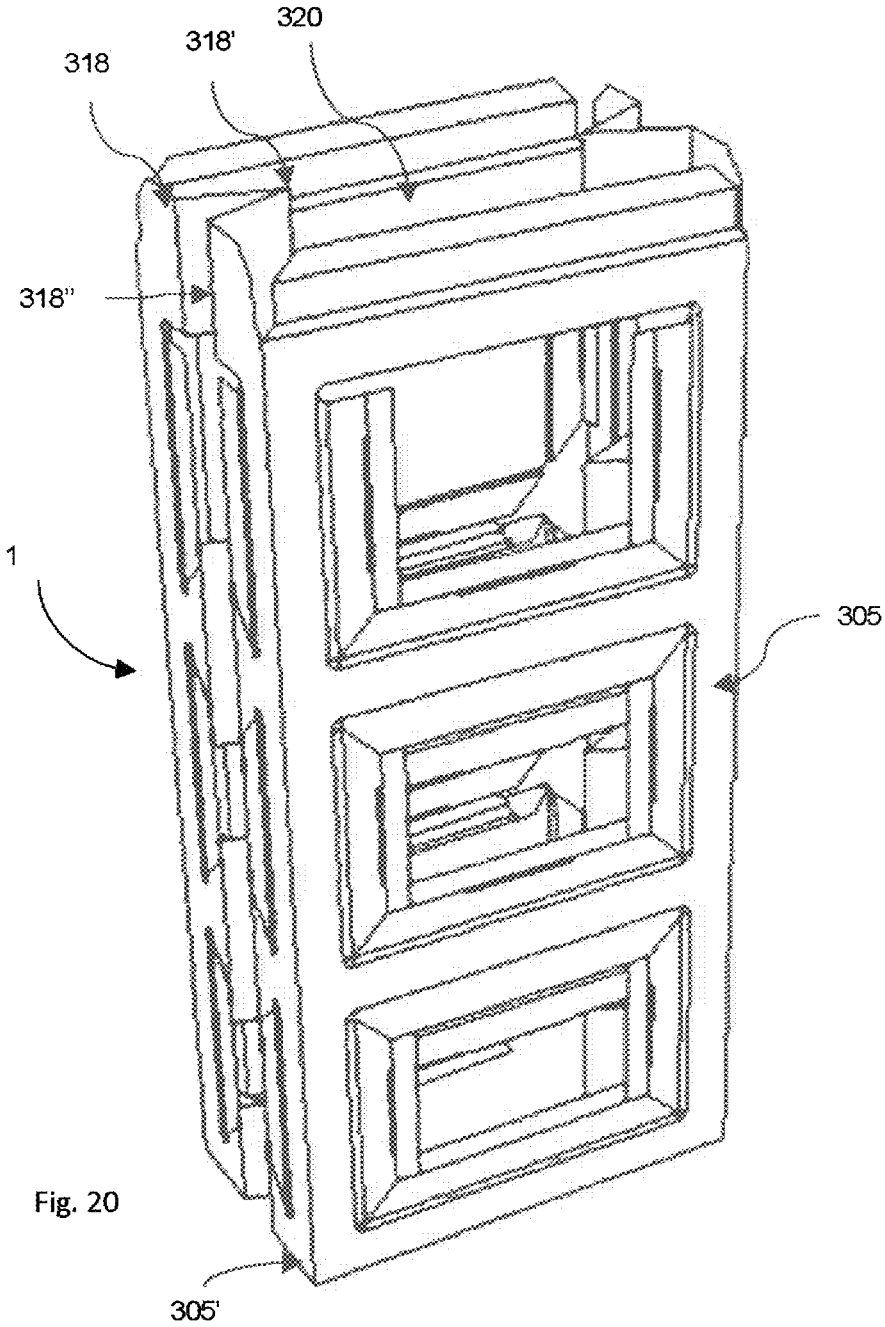
FIG. 20 is a conventional perspective view of the fourth embodiment when the jacket is in a folded position.
Figure 21:
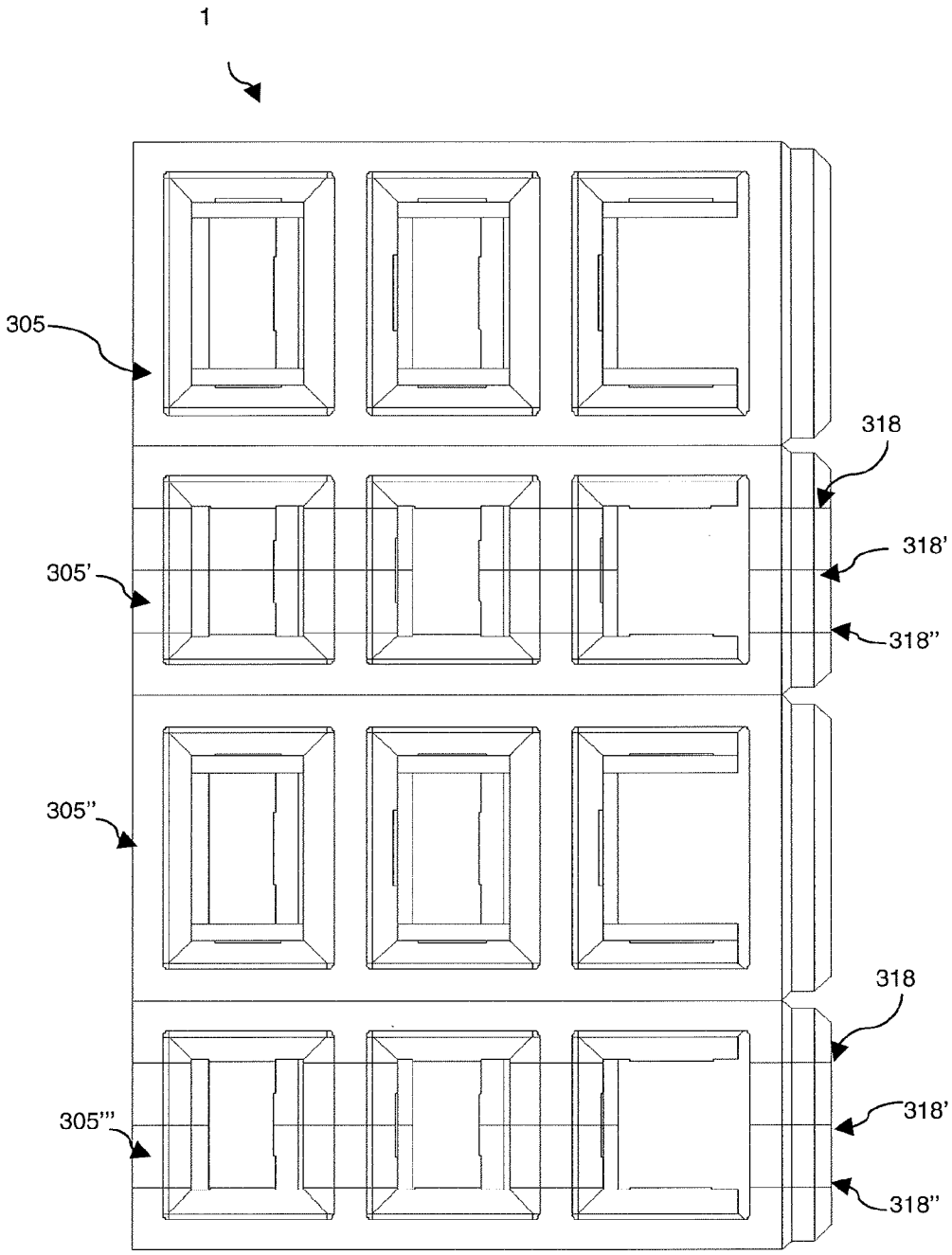
FIG. 21 is a front view of the fourth embodiment when the jacket is in an extended position.

FIGS. 18*a* through 18*j* show different embodiments of the flaps and the locking tab structure system. FIG. 18*a* shows a front view of the flap in which the ends have a loop and hook system such as Velcro® as disclosed above; FIG. 18*b* shows a protuberance 17 and groove 16 system as disclosed above; FIG. 18*c* shows a protuberance 17 and opening system 35 as disclosed above. FIG. 18*d* shows a different type of protuberance 17 and groove 16 system; specifically the protuberance 17 is similar to a semi-circle shape, whereas the groove 16 is also similar to a semi-circle. FIG. 18*e* shows the two protuberances 17 and two grooves 16 system as disclosed above; likewise, FIG. 18*j* shows more than two protuberances 17 and more than two grooves 16. FIG. 18*f* shows a different shape of protuberance, the protuberance 17 being triangular shaped, which works well with the opening 35 system as disclosed above. FIG. 18*g* shows two protuberances 17 in the same flap; an opening 35 may be present in each protuberance, wherein the openings are fitted within each other so as to form a locked tab structure. FIG. 18*h* shows that the protuberance 17 may have a specific shape such as a trapezoid shape, wherein the smaller length side of the parallel sides of the trapezoid abuts the column 2 or tray base 3 part and the larger length side of the parallel sides of the trapezoid is distant from the column 2 or tray base part 3, so that when the protuberance 17 is fitted within the groove 16, the non-parallel lateral sides of the trapezoid may form a locked tab structure with the groove 16 since the length of the larger length side of the parallel sides of the trapezoid is larger than the length of the groove 16. FIG. 18*i* shows a similar system to the above trapezoid, however the edges of the trapezoid are rounded.

Alterations to the structure described in the present document could be foreseen by those with expertise in the field. However, it must be understood that the present description is related with the preferred embodiments of the invention, which are solely for illustrative purposes, and must not be construed as a limitation of the invention. All modifications which do not part from the spirit of the invention shall be included within the body of the attached claims.

What is claimed is:

1. A jacket structure for mounting to a display structure, the jacket structure comprising:

at least one panel having an inner side and an outer side;

at least a first part and a second part corresponding to two proximate columns of the display structure;

at least one part corresponding to a tray base of the display structure, the at least one part corresponding to a tray base of the display structure intersecting with the first and second part;

the intersection of the parts corresponding to the column of the display structure and the parts corresponding to the tray base of the display structure forming a window;

a first flap in an upper side of the part corresponding to a tray base and a second flap in a lower side of the part corresponding to a tray base, wherein the first flap and the second flap are configured to lock together when in a mounted position; and a third flap formed from the first part towards the window and a fourth flap formed from the second part towards the window, wherein the third flap and the fourth flap are configured to lock together when in a mounted position.

2. The jacket structure of claim 1, wherein the second flap comprises at least a first part which abuts in a first end with the part corresponding to a tray base and a second end which is shorter in length than the first end, a second part which abuts in a first end with the second end of the first part and whose width is smaller than the first part, and a third part which abuts in a first end with a second end of the second part and whose second end comprises grooves, protuberances or a combination thereof; and wherein the first flap comprises a first part which abuts in a first end with the part corresponding to the tray base and a second end which is shorter in length than the first end and comprises protuberances, grooves or a combination thereof.

3. The jacket structure of claim 1, wherein an outwardly facing groove is provided in the inner side of the first end and the second end of the first part and the second flap of the second flap, and an outwardly facing groove is provided in the inner side of the first end of the first part of the first flap.

4. The jacket structure of claim 1, wherein the jacket comprises at least a first panel, a second panel abutting the first panel by means of a first edge in the part corresponding to columns of the display structure, and a third panel abutting at least one of the first and/or the second panel by means of a second edge in the part corresponding to columns of the display structure, wherein an outwardly facing groove is provided in the inner side of the edges of the panels.

5. The jacket structure of claim 1, wherein the jacket comprises three or more panels, wherein at least two of the abutting edges when in a mounted position of at least two panels may be separated when in an un-mounted position, wherein at least one of the abutting edges comprises a fifth flap along at least part of the height of the panel, the fifth flap comprising fastening means, and wherein the other abutting edge is configured to be fastened to the fifth flap.

6. The jacket structure of claim 5, wherein the opposing ends to the ends of the first and second part corresponding to the column part of the display structure comprise a sixth and seventh flaps along at least part of the height of the panel, the sixth and seventh flaps comprising fastening means, and wherein the sixth and seventh flaps are configured to be fastened to the fifth flap and to the other abutting edge.

7. The jacket structure of claim 1, wherein the jacket comprises three panels, wherein a first panel comprises at least one folding line which is substantially centered with regards to the first panel, the folding line included in the first and second flap and wherein an outwardly facing groove is provided in the inner side of the folding line.

8. The jacket of claim 1, wherein the jacket comprises four or more panels, wherein a first panel comprises a folding line which is substantially centered with regards to the first panel and a second panel, which is opposite to the first panel comprises a folding line which is substantially centered, wherein the folding lines are not co-lineal and wherein the folding lines is included in the first and second flap of each of the panels, and wherein an outwardly facing groove is provided in the inner side of the folding line.

9. The jacket structure of claim 1, wherein the second flap comprises at least a first part which abuts in a first end with the part corresponding to a tray base and a second end which is shorter in length than the first end, a second part which abuts in a first end with the second end of the first part and whose width is smaller than the first part, wherein at least one opening is formed at least in part between the second end of the first part and the first end of the second part; and wherein the first flap comprises a first part which abuts in a first end with the part corresponding to the tray base and a second end which is shorter in length than the first end and comprises at least one protuberance which fits within the at least one opening.

10. A jacket structure for mounting to a display structure, the jacket structure comprising:

a first panel;

a first part and second part corresponding to two proximate columns of the display structure;

a part corresponding to a tray base of the display structure intersecting with the first and second part; and a first flap in an upper side of the part corresponding to a tray base and a second flap in a lower side of the part corresponding to a tray base, wherein the first flap and the second flap are configured to lock together when in a mounted position.

11. The jacket structure of claim 10, wherein the second flap comprises at least a first part which abuts in a first end with the part corresponding to a tray base and a second end which is shorter in length than the first end, a second part which abuts in a first end with the second end of the first part and whose width is smaller than the first part, and a third part which abuts in a first end with a second end of the second part and whose second end comprises grooves, protuberances or a combination thereof; and wherein the first flap comprises a first part which abuts in a first end with the part corresponding to the tray base and a second end which is shorter in length than the first end and comprises protuberances, grooves or a combination thereof.

12. The jacket structure of claim 10, wherein an outwardly facing groove is provided in the inner side of the first end and the second end of the first part and the second flap of the second flap, and an outwardly facing groove is provided in the inner side of the first end of the first part of the first flap.

13. The jacket structure of claim 10, wherein the jacket comprises at least a first panel, a second panel abutting the first panel by means of a first edge in the part corresponding to columns of the display structure, and a third panel abutting at least one of the first and/or the second panel by means of a second edge in the part corresponding to columns of the display structure, wherein an outwardly facing groove is provided in the inner side of the edges of the panels.

14. The jacket structure of claim 10, wherein the jacket comprises three or more panels, wherein at least two of the abutting edges when in a mounted position of at least two panels may be separated when in an un-mounted position, wherein at least one of the abutting edges comprises a third flap along at least part of the height of the panel, the third flap comprising fastening means, and wherein the other abutting edge is configured to be fastened to the third flap, wherein the opposing ends to the ends of the first and second part corresponding to the column part of the display structure comprise a fourth and fifth flaps along at least part of the height of the panel, the fourth and fifth flaps comprising fastening means, and wherein the fourth and fifth flaps are configured to be fastened to the third flap and to the other abutting edge.

15. The jacket structure of claim 10, wherein the jacket comprises three or more panels, wherein at least one panel comprises at least one folding line which is substantially centered with regards to the first panel, the folding line included in the first and second flap and wherein an outwardly facing groove is provided in the inner side of the folding line, and wherein if a second panel, which is opposite to the first panel comprises a folding line which is substantially centered the folding lines are not co-lineal and wherein the folding lines is included in the first and second flap of each of the panels, and wherein an outwardly facing groove is provided in the inner side of the folding line.

16. The jacket structure of claim 10, wherein the second flap comprises at least a first part which abuts in a first end with the part corresponding to a tray base and a second end which is shorter in length than the first end, a second part which abuts in a first end with the second end of the first part and whose width is smaller than the first part, wherein at least one opening is formed at least in part between the second end of the first part and the first end of the second part; and wherein the first flap comprises a first part which abuts in a first end with the part corresponding to the tray base and a second end which is shorter in length than the first end and comprises at least one protuberance which fits within the at least one opening.

* * * * *